US010304278B2

(12) United States Patent
Lyons et al.

(10) Patent No.: US 10,304,278 B2
(45) Date of Patent: May 28, 2019

(54) SYSTEM, METHOD AND APPARATUS FOR VIRTUAL REALITY GAMING WITH SELECTABLE VIEWPOINTS AND CONTEXT-SENSITIVE WAGER INTERFACES

(71) Applicant: Bally Gaming, Inc., Las Vegas, NV (US)

(72) Inventors: Martin Lyons, Henderson, NV (US); Rolland Steil, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/494,885

(22) Filed: Apr. 24, 2017

(65) Prior Publication Data

US 2017/0316639 A1 Nov. 2, 2017

Related U.S. Application Data

(60) Provisional application No. 62/328,142, filed on Apr. 27, 2016.

(51) Int. Cl.
*G07F 17/32* (2006.01)

(52) U.S. Cl.
CPC ..... *G07F 17/3211* (2013.01); *G07F 17/3209* (2013.01); *G07F 17/3223* (2013.01); *G07F 17/3244* (2013.01); *G07F 17/3288* (2013.01)

(58) Field of Classification Search
CPC ..... G07F 17/3204; G07F 17/3206; G07F 17/3211; G07F 17/3218; G07F 17/3272; G07F 17/3293; A63F 13/25; A63F 13/428; A63F 2009/2447; A63F 2009/2479
See application file for complete search history.

(56) References Cited

U.S. PATENT DOCUMENTS

| | | | | |
|---|---|---|---|---|
| 6,159,095 | A | 12/2000 | Frohm et al. | |
| 7,871,327 | B2 | 1/2011 | Walker et al. | |
| 8,932,124 | B2 | 1/2015 | Lutnick et al. | |
| 9,247,212 | B2 | 1/2016 | Bose et al. | |
| 9,298,283 | B1 | 3/2016 | Lin et al. | |
| 9,308,439 | B2 | 4/2016 | Aoki et al. | |
| 2007/0149291 | A1* | 6/2007 | Mitchell | A63F 13/08 463/46 |
| 2009/0023489 | A1* | 1/2009 | Toneguzzo | G07F 17/32 463/16 |
| 2011/0201414 | A1* | 8/2011 | Barclay | G07F 17/3206 463/25 |
| 2011/0275432 | A1* | 11/2011 | Lutnick | G07F 17/3232 463/25 |

(Continued)

FOREIGN PATENT DOCUMENTS

WO WO 2014/194135 A1 12/2014

*Primary Examiner* — Lawrence S Galka
(74) *Attorney, Agent, or Firm* — Marvin A. Hein

(57) ABSTRACT

A gaming system includes an input interface, an output interface and processing circuitry. A data stream defining a VR environment is transmitted by the processing circuitry to a VR headset. The VR headset displays visual imagery depicting the VR environment seen from a first viewpoint. The processing circuitry receives an input indicative of a selection of a second viewpoint and directs the VR headset to display visual imagery depicting the VR environment seen from the second viewpoint.

19 Claims, 7 Drawing Sheets

(56) References Cited

U.S. PATENT DOCUMENTS

| | | | | |
|---|---|---|---|---|
| 2014/0113716 | A1 | 4/2014 | Mukhopadhyay | |
| 2014/0121015 | A1 | 5/2014 | Massing et al. | |
| 2014/0171039 | A1 | 6/2014 | Bjontegard | |
| 2015/0221183 | A1* | 8/2015 | Colvin | G07F 17/3293 463/11 |
| 2016/0001175 | A1 | 1/2016 | Aronzon et al. | |
| 2016/0175709 | A1* | 6/2016 | Idris | A63F 13/211 463/32 |
| 2017/0046906 | A1* | 2/2017 | Hilbert | G07F 17/3209 |

* cited by examiner

SYSTEM, METHOD AND APPARATUS FOR VIRTUAL REALITY GAMING WITH SELECTABLE VIEWPOINTS AND CONTEXT-SENSITIVE WAGER INTERFACES

CROSS-REFERENCE TO RELATED APPLICATION

This application claims the benefit under 35 U.S.C. § 119(e) of U.S. Provisional Patent Application Ser. No. 62/328,142 filed 27 Apr. 2016.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to the virtual reality gaming in an environment with player-selectable viewpoints.

BACKGROUND OF THE INVENTION

Gaming establishments (e.g., casinos, arcades, resorts, etc.) seek to attract players by providing various gaming and gaming-related activities at their venues, and may further offer non-gaming entertainment such as live music, theater, and restaurants in hopes of introducing and retaining customers at such venues where gaming is available. In this way, gaming establishments endeavor to provide cutting-edge entertainment technology whether it is directly related to gaming or not. Sportsbooks, in which a player may observe and wager on a variety of live and virtual events, are a popular complement to casino gaming and have become familiar additions to gaming establishments. In addition, sportsbook activities lend themselves to enhancements including advances in video presentations and expanded wagering opportunities.

Virtual reality (VR) equipment and content providers are becoming increasingly sophisticated and VR experiences are gaining popularity. VR versions of multi-player games, "you-are-there" sports presentations of actual sporting events as well as computer-generated sports, 3D and interactive theater, gaming, or sports, all attract a lot of attention and interest among the public. Additionally, VR leverages communication networks (e.g., the Internet) by facilitating remote participation in gaming and other entertainment vehicles that closely resembles the realism and urgency of "being there" in the flesh. It would be advantageous for a gaming establishment to embrace this immersive technology as at least a part of the gaming experience.

SUMMARY OF THE INVENTION

According to one aspect of the present invention, a gaming system includes an input interface configured to receive data from an input device and an output interface configured to transmit data to a VR headset. The gaming system further includes processing circuitry configured to transmit a data stream defining a VR environment to the VR headset. The processing circuitry directs the VR headset to display visual imagery depicting the VR environment seen from a first viewpoint including a first betting interface that includes one or more wager characteristics enabled in the first viewpoint. The processing circuitry is further configured to receive an input indicative of a selection of a second viewpoint that is different from the first viewpoint. The processing circuitry directs the VR headset to display visual imagery depicting a VR environment seen from the second viewpoint including a second betting interface with one or more different wager characteristics enabled in the second viewpoint.

According to another aspect of the present invention, a gaming system includes an input interface configured to receive data from an input device and an output interface configured to transmit data to a VR headset. The gaming system further includes processing circuitry configured to transmit a data stream defining a VR environment to the VR headset. The processing circuitry directs the VR headset to display visual imagery depicting the VR environment seen from a first viewpoint including a plurality of selectable viewpoints. The processing circuitry is further configured to receive an input indicative of a selection of a second, different viewpoint from the plurality of selectable viewpoints. The processing circuitry directs the VR headset to display visual imagery depicting a VR environment seen from the second viewpoint, and receives from a player an input indicative of a wager associated with the VR environment seen from the second viewpoint.

According to yet another aspect of the present invention, a method of controlling a gaming system is disclosed. The gaming system includes an input interface configured to receive data from an input device, an output interface configured to transmit data to a VR headset, and processing circuitry connected to the input and output interfaces. The method includes authenticating, by the processing circuitry, an identifier associated with a player activating the VR headset and storing the identifier in a memory device. The method further transmits a data stream defining a VR environment to the VR headset and directs the VR headset to display visual imagery depicting the VR environment seen from a first viewpoint that includes a visual representation of a first betting interface. The first betting interface includes one or more wager characteristics enabled in the first viewpoint. The method further includes receiving from the player an input indicative of a selection of a second viewpoint that is different from the first viewpoint. The method includes directing the VR headset to display visual imagery depicting a VR environment seen from the second viewpoint that includes a visual representation of a second betting interface. The second betting interface includes one or more different wager characteristics enabled in the second viewpoint. The method receives from the player an input indicative of a wager corresponding to at least one of the one or more different wager characteristics and associates the wager with the stored identifier.

Additional aspects of the invention will be apparent to those of ordinary skill in the art in view of the detailed description of various embodiments, which is made with reference to the drawings, a brief description of which is provided below.

Figure 1:
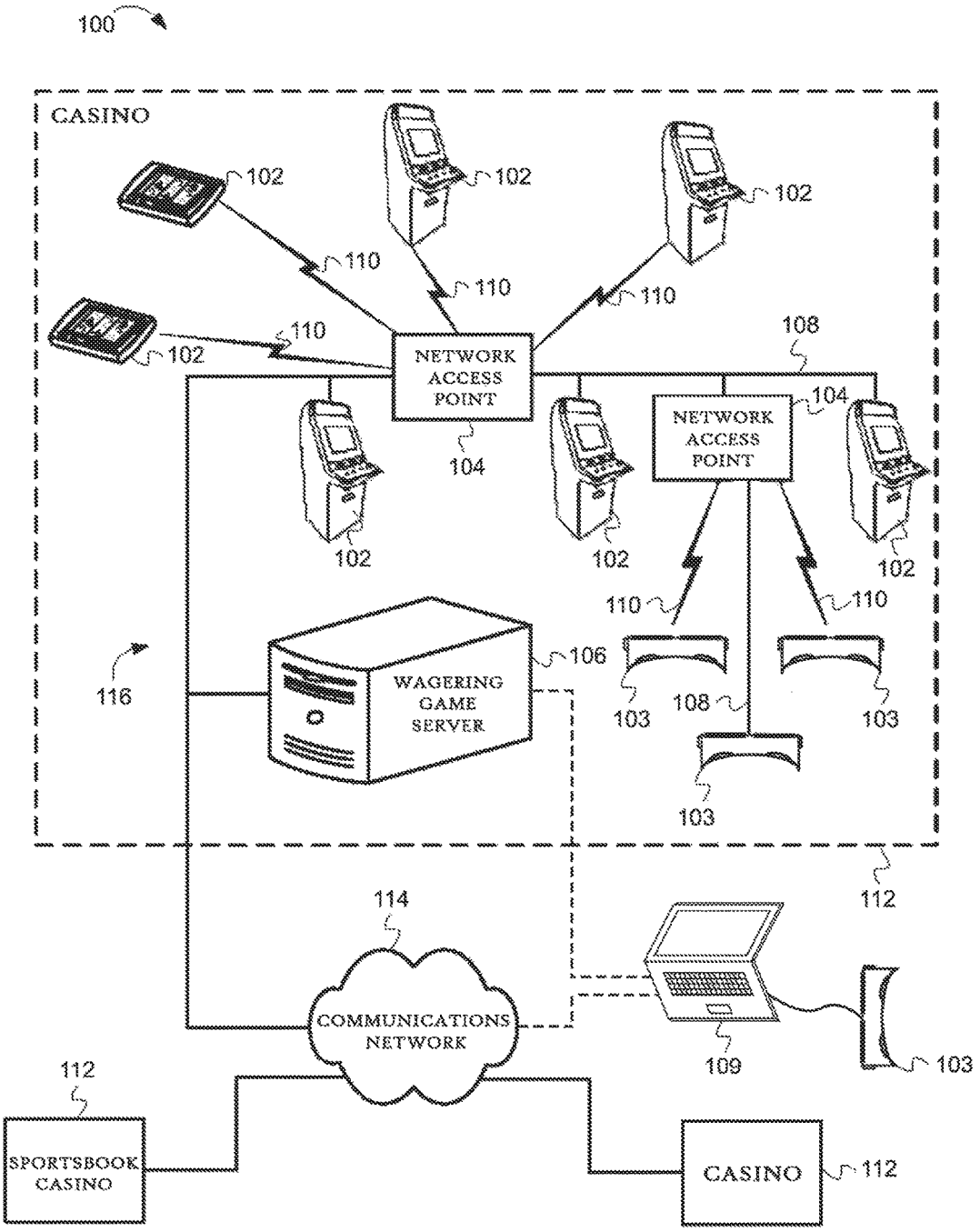
FIG. 1 is a schematic depiction of a gaming system according to an embodiment of the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible to embodiment in many different forms, there is shown in the drawings and will herein be described in detail various embodiments of the invention with the understanding that the present disclosure is to be considered an exemplification of the principles of the invention and is not intended to limit the broad aspect of the invention to the illustrated embodiments. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

For purposes of the present detailed description, the terms "user interface," "interface," "visual field," "audio field," "pick field," "virtual reality," "VR," "visual/audio presentation/component," and the like describe aspects of an interaction between an electronic device and the player. This interaction includes perceivable output (e.g., audio, video, tactile, etc.) that is observed by the player, as well as electronically-generated input generated from real-world events (e.g., actuated buttons, physical position information, etc.) caused by the player or another real-world entity. In some embodiments, perceivable output may include a variety of information presented to a player (e.g., live sporting events, live casino gaming events, computer generated wagering games, etc.) using a number of perceivable stimuli, in a variety of formats using a variety of equipment (e.g., flat-screen computer monitor, curved monitor, VR headset, three-dimensional television, audio loudspeakers, audio headphones, directional audio, hypersonic sound projector, ranged acoustic device, three-dimensional audio, etc.). In some embodiments, electronically generated input may include actuating or specifying specific regions or buttons of keyboards or touchscreens, detecting physical positions of pointing devices or sensors using relative or absolute measurements, and/or processing information gathered from one or more input devices to derive a resultant input signal containing information.

In an embodiment of the invention, an entertainment or gaming establishment may connect a player to a real or virtual venue such as a sportsbook or gaming room via VR input/output with a gaming system from within a gaming establishment, from a non-wagering area of a casino such as a restaurant, hotel room, family game room, etc., or from outside of a gaining establishment via some kind of communication network. Preferably, but not necessarily, the VR input/output system will comprise a VR headset, and "VR headset" will be used here and throughout to represent a general VR input/output system that may or may not include a headset.

For example, a VR head-mounted display may function as both an output display device and an input information gathering device. One example of this type of combination input/output device is the VR headset and functional processing unit sold as the Oculus Rift™ or Samsung Gear VR™, manufactured by Oculus VR of Menlo Park, Calif., USA. Other products offered by this company or others may be coupled to a gaming system, the headset, etc., and may include other input and output devices like pointers, actuation buttons, audio speakers, etc.

A VR headset may include sensors such as accelerometers, inclinometers, infrared and other types of cameras and imagers, etc. to provide enhanced features like head-tracking, eye-tracking, biometric identification and other features. Head-tracking, in particular, utilizing data from one or more embedded sensors, may be implemented to enable 360° viewing capability. For example, by turning one's head or body, the view field imaged by the VR headset may revolve to reveal aspects of the VR environment "behind" (and/or above or below) the player. Similarly, parallax effects can be applied to images in the view field corresponding to movements of the headset to simulate a more realistic 3D environment. Various other features and capabilities may be provided by the VR headset. An exemplary (and non-limiting) VR headset is disclosed in U.S. patent application Ser. No. 14/823,789 ("Gaming Machine and System for Concurrent Gaming Player Interface Manipulations Based on Visual Focus), which is incorporated by reference in its entirety.

In some cases, the communication network may be an intranet provided by the gaming establishment. The communication network may be an open network such as the Internet, and may be a combination of an intranet and an open network. The establishment providing access to the VR environment may impose various criteria necessary for gaining access to the environment, including but not limited to fees, membership, identity verification, etc.

In an embodiment, a player may connect to the gaming system via a VR headset and be introduced to a VR environment defined by a data stream transmitted to the VR headset from the gaming system. The data stream transmitted by the gaming system may deliver pre-rendered, streaming visual and audio imagery directly to the VR headset. Alternatively, the data stream may comprise raw or partially rendered data that includes stored visual and/or audio imagery. The data stream may further include instructions for rendering a portion of the data into three-dimensional scenarios and may be configured to receive inputs from various sources such that the received inputs affect visual, audio, or other aspects of the VR environment. The data stream may be rendered and/or otherwise processed by local or remote processing circuitry and transmitted to the VR headset for display to the player. Alternatively, the data stream may be rendered by processing circuitry resident in the VR headset. The data stream may be delivered to the player via a direct transmission line, via an intranet communications network, via the Internet, or via various other data delivery means and methods. Processing circuitry resident in one or more components of the gaming system and/or the VR headset may execute instructions to generate one or more elements of the data stream and to alter the one or more elements in response to received inputs from various sources.

Referring now to FIG. 1, a wagering game system 100 is shown according to an example embodiment of the invention. The wagering game system 100 may include more than one casino 112 connected to a communications network 114. Each casino 112 may include an intranet 116 (or local area network), which includes an access point 104, a wagering game server 106, wagering game machines 102, and VR headsets 103. The access points 104 provide wireless communication links 110 and wired communication links 108. The wired and wireless communication links can employ any suitable connection technology, such as Bluetooth, 802.11, Ethernet, public switched telephone networks, SONET, etc. In some embodiments, the wagering game server 106 can provide wagering games and distribute content to devices located in other casinos 112 or at other locations on the communications network 114. One or more of the casinos 112 may include a sportsbook casino enabling players to wager on live or time-delayed sporting events.

The wagering game machines 102 described herein can take any suitable form, such as floor standing models, handheld mobile units, bartop models, workstation-type console models, etc. In an embodiment, a VR headset may act as a wagering game machine. Further, the wagering game machines 102 can be primarily dedicated for use in conducting wagering games, or can include non-dedicated devices, such as mobile phones, personal digital assistants, personal computers, etc. In one embodiment, the wagering game system 100 can include other network devices, such as accounting servers, wide area progressive servers, player tracking servers, and/or other devices suitable for use in connection with embodiments of the invention.

VR headsets 103 may be connected to the communication network 114, directly to the wagering game server 106, to another remote game server residing somewhere on the communication network, or to a remote computer 109 receiving VR data either related or unrelated to wagering games. Other methods and means for delivering VR data (e.g., wireless, satellite, commercial cable, etc.) are envisioned to be included in the spirit of the invention. For example, VR data may incorporate a live feed from an actual sporting event. Modes and methods for processing a live feed or other data from a remote source may vary. The remote computer 109 may receive the VR data and render the data for delivery to the VR headset as video and/or audio sensory imagery. Alternatively, the VR data may be transmitted pre-rendered directly to the headset 103.

Additionally, one or more VR headsets 103 may be connected to the network via a wireless access point 104. The gaming system may include various input interfaces and output interfaces to facilitate connections with different components and various internal and external communication networks. The headsets 103 may alternatively be coupled directly or indirectly to a particular wagering game machine 102, wired or wirelessly, enabling a player to interact with that wagering game machine 102 to play a wagering game. Further, the headsets 103 may communicate with one or more wagering game servers 106 to send information (e.g., audio, video, game imagery, etc.) and receive information (e.g., head/eye/headset orientation, position, selections, etc.) for presenting, conducting, and playing the wagering game(s).

In the VR environment, the player may place wagers on games and events presented in the VR environment. For example, the VR environment may display video imagery of one or more sports events (either computer-generated, stored, or live imagery) and the player may place a wager on an outcome of an incident taking place in one of the sports events. Alternatively, the VR environment may display video imagery of casino-type game machines or table games and the player may place a wager on a game on a machine or table. Using a VR headset (and/or various other VR input/output devices), a player may be immersed in the VR environment and the games or sporting events presented in the VR environment.

In an exemplary embodiment, a player accessing the gaining system enters a VR environment that depicts a sportsbook seen from a first viewpoint. The sportsbook first viewpoint may include multiple screens or windows that display various sporting events that are available at the sportsbook. The data stream that defines the sportsbook VR environment may include visual and audio information that replicates the sounds and experience of a live sportsbook or may include visual and/or audio feeds from an actual live sportsbook.

In an embodiment of a sportsbook VR environment, VR imagery may comprise images of real events and real people, may comprise computer-generated surroundings and characters, and may comprise combinations thereof. For example, the VR environment may provide dynamic images of other players and sportsbook employees in proximity to the multiple screens, sitting at tables or standing at counters, and moving in and out of the player's view. The other players and sportsbook employees may comprise computer-generated characters ("avatars"), live-action video representations of real people, and combinations thereof. Avatars may be controlled by programming code, may be controlled by inputs received from other players, and may be controlled by a combination of programming code and received inputs. Actions and occurrences depicted in the VR environment may be affected by inputs received from various sources.

The VR environment may include one or more additional viewpoints that provide alternative experiences to the player. The additional viewpoints may be visually identifiable from the first viewpoint, and may be individually selectable by the player. In a sportsbook VR environment, one or more of the various sporting events tracked by the sportsbook and depicted on screens in the sportsbook may include selectable second viewpoints. Selecting a second viewpoint may change the VR environment from the first viewpoint to the second viewpoint, which may be located in a completely different venue. For example, selecting one of the screens in the first viewpoint (e.g., in the sportsbook) may "teleport" the player directly to a second, different viewpoint. The second viewpoint may effectively place the player in a completely different environment from the first viewpoint so, for example, the player may seem to be instantaneously teleported from the sportsbook venue to a seat in a stadium where a football game is being played. In the VR environment, space and time dislocations may be effortlessly implemented—giving the player the impression that laws of physics may be suspended. Selections may be realized via various input modes and methods, as will be discussed later in this paper.

Figure 2:
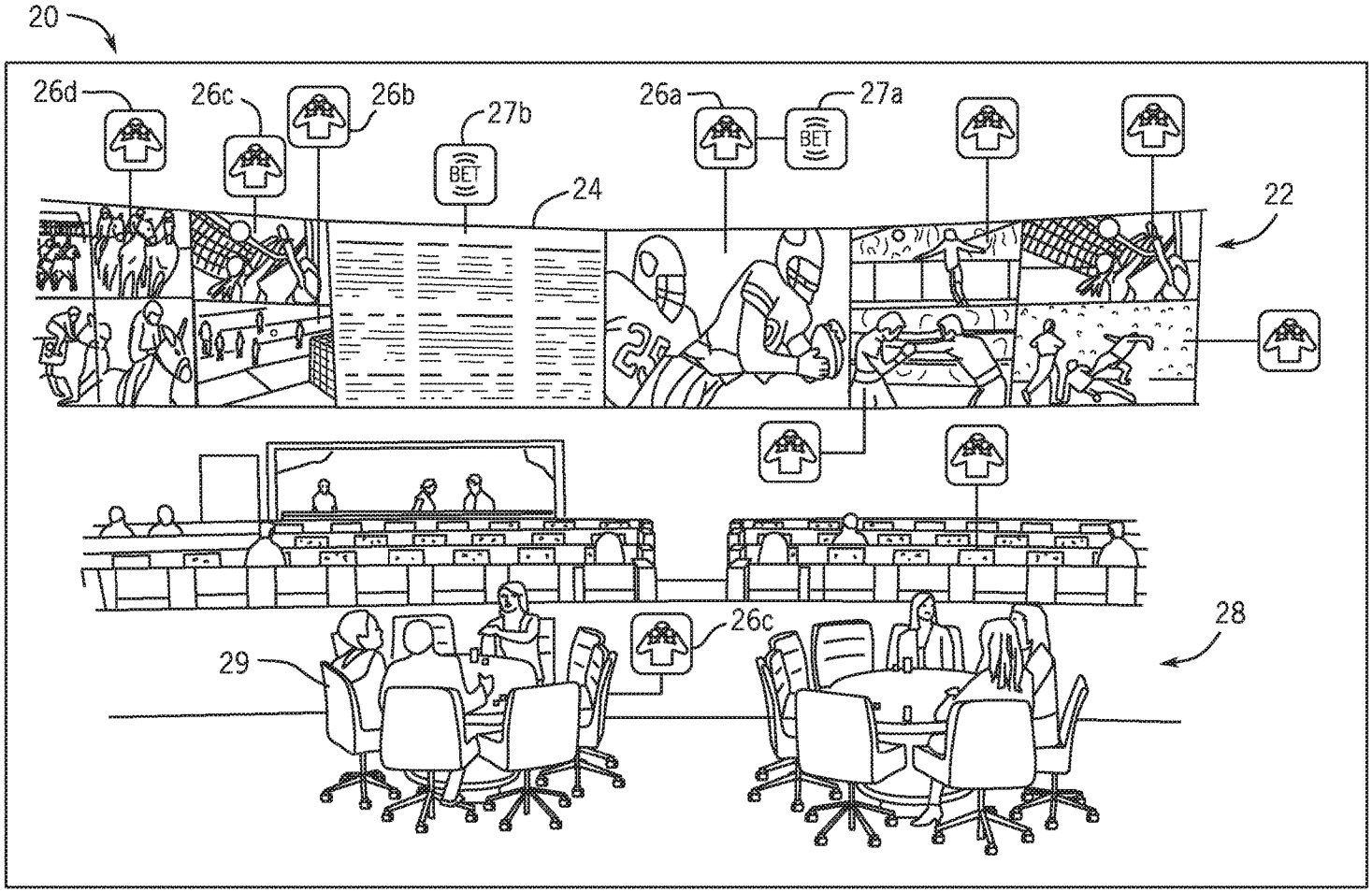
FIG. 2 is an image of an exemplary VR environment depicting a sportsbook.

FIG. 2 is a depiction of an embodiment of a VR sportsbook environment seen from a first viewpoint 20. The first viewpoint 20 includes a plurality of screens 22 displaying sporting events and at least one tally screen 24 with compiled wager information about multiple sporting events. Also visible in the first viewpoint 20 are various selectable viewpoint icons 26*a-e*. A viewpoint icon 26*a-e* may be selected by a player viewing the VR sportsbook and, after the selection, the processing circuitry may respond to the selection by teleporting the player to the selected viewpoint.

For example, selecting the viewpoint icon 26*a* (on the screen displaying the football game) results in the player being teleported to a second viewpoint seen from a seat in the football stadium where the football game is taking place. Similarly, selecting any of the viewpoint icons 26*b-d* will teleport the player to a venue hosting the sporting event displayed on the corresponding screen 22.

The VR sportsbook of FIG. 2 further depicts some gaming tables 28 hosting wagering games such as poker, baccarat, blackjack, etc. Other tables may provide craps games, roulette, and various other games of chance such as may be found in a casino. These alternative wagering games may be displayed with corresponding viewpoint icons, for example, the viewpoint icon 26*e*. A player selecting the viewpoint icon 26*e* may be teleported to a seat 29 at the gaming table with a view of other players displayed as simulated avatars or even as real characters.

Figure 3:
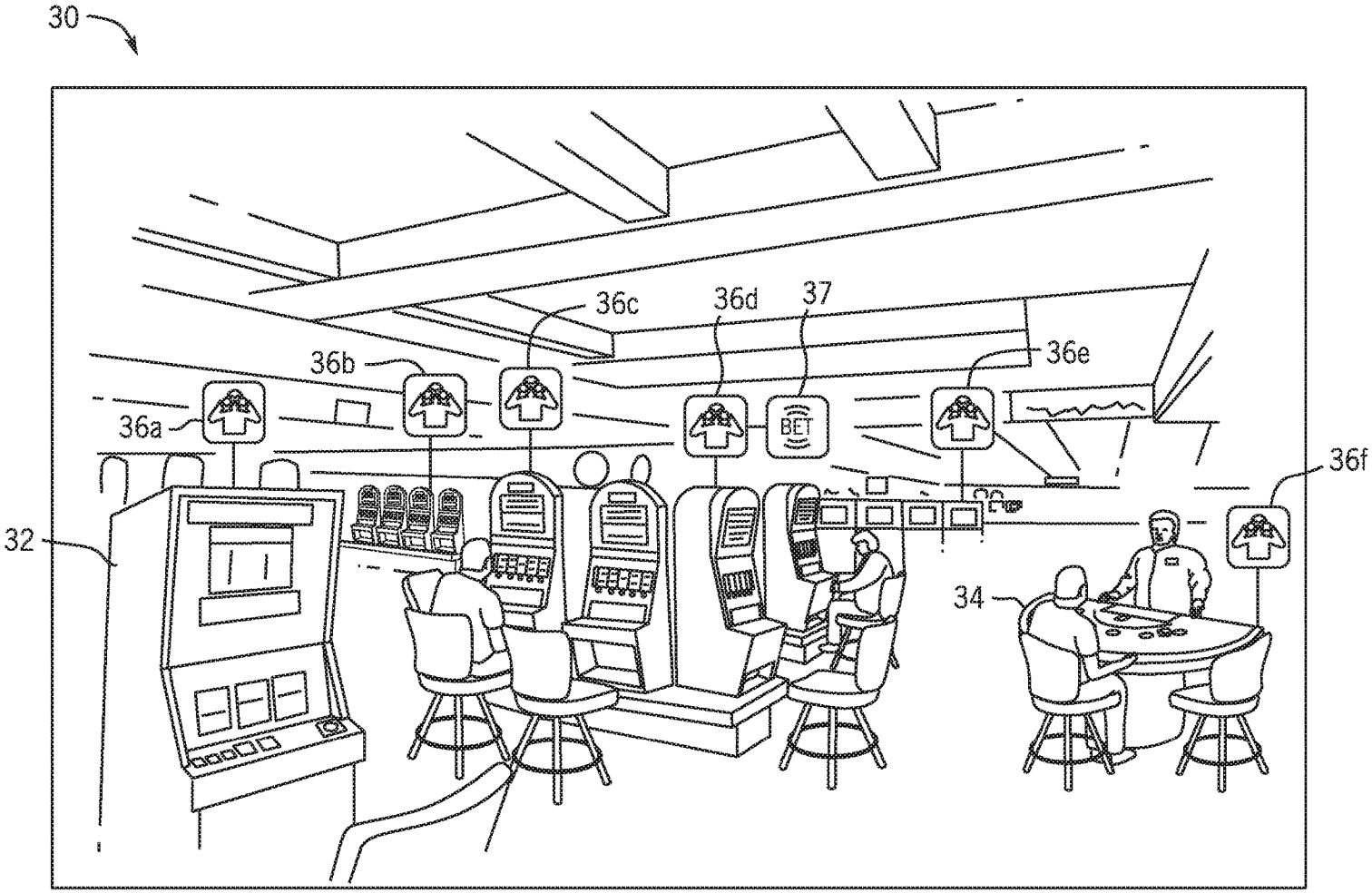
FIG. 3 is an image of an exemplary VR environment depicting a casino game room.

FIG. 3 shows a VR environment that depicts an exemplary game room, seen from a first viewpoint, such as may be found in a casino. As in the VR sportsbook of FIG. 2, the VR casino 30 may comprise computer-generated imagery, video imagery from a live feed in an actual casino, and a combination of computer-generated and live video imagery. A player entering the VR casino 30 may experience visual and audio imagery depicting the excitement and cacophony of a busy casino including gaming machine sounds, cheers and laughter from other players, music, lighting effects and movement.

Figure 4:
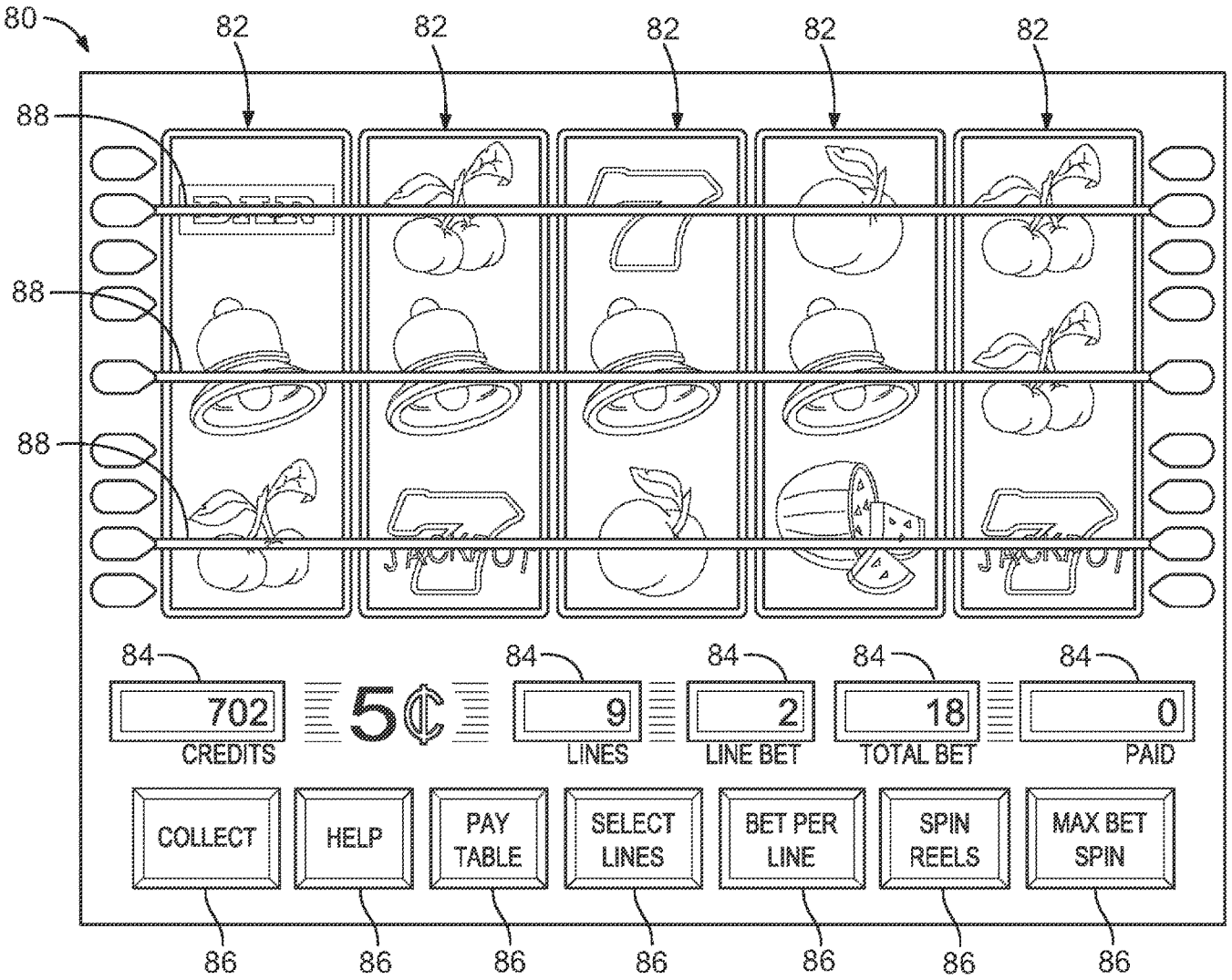
FIG. 4 is an image of an exemplary wagering game screen.

As seen in FIG. 3, the VR casino 30 includes a plurality of gaming machines, such as gaming machine 32, as well as some gaming tables 34. Also displayed are selectable viewpoint icons such as icons 36*a-f*. A player selecting the icon 36*a* may be teleported to a seat in front of the gaming machine 32 and presented with an image of a basic-game screen 80 such as that shown in FIG. 4. From the basic-game screen 80, the player may play the game(s) offered on the gaming machine 32 by utilizing the touchscreen buttons 86 or other input devices. The basic-game screen 80 portrays a plurality of simulated symbol-bearing reels 82. Alternatively or additionally, the basic-game screen 80 may portray other video or mechanical presentations consistent with the game format and theme. The basic-game screen 80 may include one or more game-session credit meters 84 and various touch screen buttons 86 adapted to be actuated by a player. These and other features will be familiar to players of casino wagering game machines. Selecting any of the viewpoint icons 36*b-e* places the player at a corresponding gaming machine in the VR casino. Similarly, selecting the viewpoint icon 36*f* will teleport the player to a seat 34 at the gaming table with a display portraying a poker game, blackjack game, or other casino table game.

One or more games and events provided in the VR environment may be presented with a betting interface corresponding to the displayed game or event. Wager characteristics presented in the betting interface may be directly related to a current viewpoint of the VR environment, may be related to a previous viewpoint, and may be related to multiple viewpoints of the VR environment. Through a betting interface, a player may make wagers on the outcomes and occurrences in the corresponding game or event. A betting interface may provide information related to the game or event as well as wager characteristics such as a point spread and betting odds on a particular play or other incident that may happen in the event. Referring back to FIG. 2, a betting interface may be accessible via a dedicated "BET" icon, such as the icon 27*a-b*, and may be automatically presented with any of the viewpoints provided by selection of a viewpoint icon. The BET icon 27*b* associated with the tally screen 24 may include information related to a plurality of sporting events tracked by the sportsbook, with wager characteristics corresponding to the specific events. Alternatively, the BET icon 27*a* may include only information related to the football game depicted on the screen. The VR casino also may include a BET icon, such as BET icon 37, that displays wager characteristics related to one or more of the games displayed in the VR casino.

Figure 5:
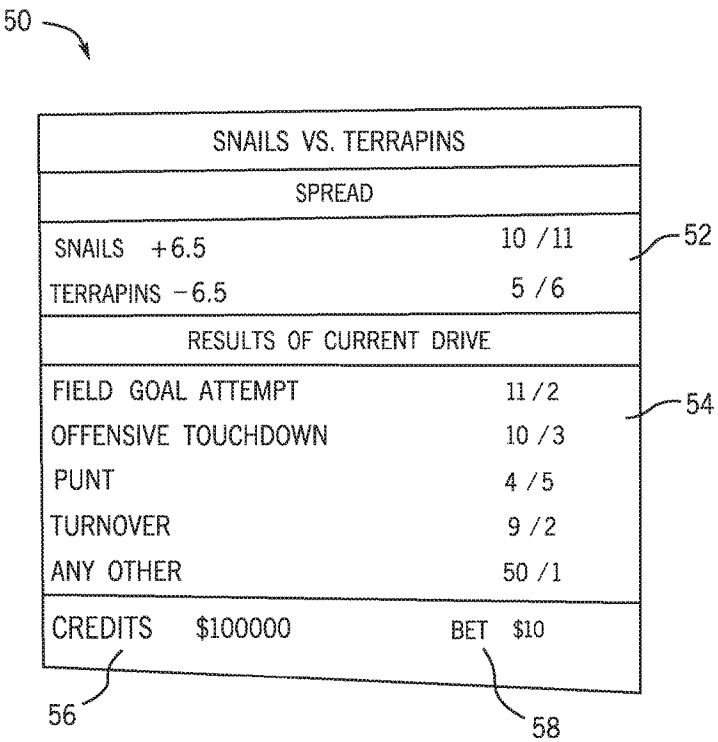
FIG. 5 is an image of an exemplary betting interface accessed in a VR environment.

FIG. 5 shows an exemplary betting interface 50 such as may be related to the football game displayed on a video screen 22 in FIG. 2. The betting interface 50 may be presented to the player automatically in the viewpoint associated with the viewpoint icon 26*a* in FIG. 2, and the betting interface 50 may also be presented separately when the BET icon 27*a* is selected without switching to another viewpoint. The betting interface 50 includes wager characteristics related to the football game between the Terrapins and the Snails.

Players may configure wagers via the betting interface 50. The wager characteristics displayed may be selectable via player inputs. Various selections, including wager amounts, may be tallied up and the wagers debited from the player's credit balance. Some of the wager characteristics 52 in this case are related to the "point spread," or just the spread, between the opposing teams. The spread may be described as a normalizing factor or a handicap intended to generate betting interest for both teams—the favorite and the underdog, by only paying off bets on the favorite team if they win by more than the spread and paying off on the underdog if they at least lose by less than the spread (or if they win). In the betting interface 50, the Terrapins are the favorites with a −6.5 point spread and the Snails are the underdog with a +6.5 point spread. The payouts for bets on either team are displayed opposite the team names so, for example, an $11 wager on the Snails (the underdog) pays $10, and a $6 wager on the Terrapins (the favorite) pays $5. Some additional wager characteristics 54 displayed in betting interface 50 include characteristics related to the upcoming play (i.e., "Current Drive"), such as a wager that the next play will be a field goal attempt (pays $11 on a $2 bet), an offensive touchdown, a punt, etc. Also displayed in the betting interface 50 are a credit balance 56 (presumably associated with the player viewing the betting interface) and a wager denomination 58. Many variations in wager characteristics can be easily envisioned and are within the spirit and scope of the invention, including a player-input process that accepts custom-defined wagers (e.g., Pass tipped, recovered by Defense). Customized wager capability may be accompanied by custom odds that are dynamically generated by the gaming system in response to the player's custom wagers.

A casino VR environment may also include one or more betting interfaces with similar functions as those described above. In FIG. 3, the BET icon 37 may produce a betting interface with wager characteristics related to an in-progress wagering game of another player at the corresponding gaming machine. Alternatively, the BET icon 37 may present a betting interface for passive game play in which a player can contract for multiple spins or plays to be executed without further input from the player.

Similarly, in a VR environment depicting a Hold'em Poker game from a detached viewpoint (i.e., viewing the table and all players but no player-held cards), a betting interface may include selectable characteristics to predict the next community card, whether the next bettor folds, calls, or raises (or goes all in), or which player will take the pot. If the player switches from the detached viewpoint to a particular player's viewpoint (with a view of that player's hole cards), the betting interface may change to include odds on that player's hand winning the pot, whether the player will bluff, fold, or raise more than 2× the blind, and if the community cards will have more red or black cards.

Another embodiment may enable a player to be an active participant in a game. For example, a player in a casino VR environment seen from a craps table view may select an Active Player icon (not shown) to queue for next shooter. While in the queue, the player may wager on outcomes of other shooters just like any other passive player but, when their turn comes, they can roll to make their point or seven out via any type of input accepted by the gaining system.

A betting interface may be configured to provide selectable wager characteristics that a player can select using various input devices and methods. Some of these input devices and methods are described above, but the available input modes are not limited by this disclosure. A player may utilize a separate button deck, a joystick input device, a mouse or trackball, and various other conventional and custom input devices. Additionally, input devices and methods associated with VR headsets such as those described in abovementioned U.S. patent application Ser. No. 14/823,789 ("Gaming Machine and System for Concurrent Gaming Player Interface Manipulations Based on Visual Focus) may be utilized with a betting interface. When selectable wager characteristics are provided, wager characteristics may dynamically update in response to selections by one or more players betting on a game event. For example, horse racing odds and payouts may change as wagers are placed on a particular event.

Figure 6:
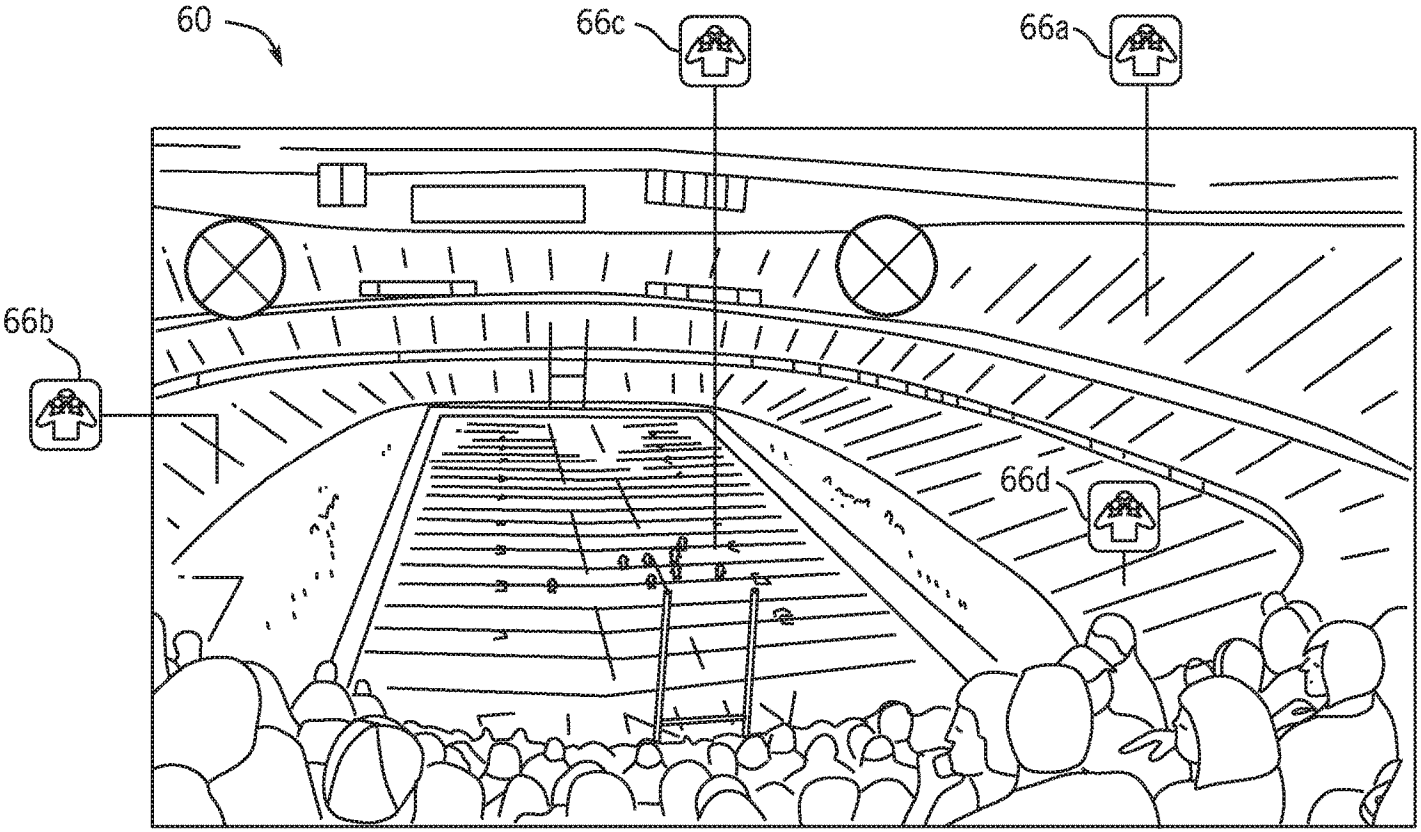
FIG. 6 is an image of an exemplary VR environment from a viewpoint in a football stadium.

As described above, when a player selects viewpoint icon, such as the viewpoint icon 26*a* in the VR sportsbook, the resulting VR data stream may "teleport" the player to a VR environment seen from a second viewpoint. As shown in FIG. 6, the second viewpoint 60 is seen from a seat in a stadium where a football game is being played. The second viewpoint 60 is in an upper deck behind the goal. The second viewpoint 60 may be presented as a computer-generated virtual stadium, however, in an embodiment of the invention, second viewpoint 60 may be a video feed from a 360° camera or other camera located in an actual stadium. The video feed may be provided in "real-time" or "near real-time," may be stored imagery, and may be a mixture of live and stored images. While video from a 360° camera is not required for a VR experience, the 360° viewing capability coupled with a hi-quality VR headset facilitates a full 3D viewing experience for the player. For example, sensors in the VR headset may track the player's head movements and control the display of the video imagery to pan and scan in correspondence with the head movements to provide a realistic view-scanning display of the player's entire virtual surroundings. Additionally, the player may have control over their view direction as opposed to other visual entertainment forms in which the view is wholly controlled by the entertainment provider. So, for example, a player at the second viewpoint may choose to watch the coach on the sidelines during a play, rather than focus on the action on the field. Similarly, a player may elect to look at the spectators around them or watch the jumbotron—the player wearing the VR headset is in control.

Multiple viewpoints may enable a VR-equipped player to "drill down" through the various viewpoints by selecting viewpoint icons that are visible in or otherwise available from a current or previous viewpoint. In an embodiment, a viewpoint may include icons that skip over one or more levels of viewpoints, for example, a player at a first viewpoint in a VR sportsbook may teleport directly to a helmet-camera viewpoint of a player on the field without selecting an intermediary viewpoint in a stadium. Similarly, a player may teleport directly back to the VR sportsbook first viewpoint from any other viewport, and may teleport directly to a VR casino first viewpoint from a place at a poker table without first selecting an intermediary "poker area" viewpoint.

A VR environment seen from a second viewpoint, such as viewpoint 60, may include additional viewpoint icons, for example viewpoint icons 66*a-d*. An additional viewpoint may allow the player to view the field from another seat in the upper deck (66*a*) and from a seat near the 50 yard line (66*b* and 66*d*). Selecting certain viewpoints (e.g., 50 yard line seats) may require an additional fee or wager. Similarly, selecting icons for certain sporting events may incur different charges or may impose different eligibility criteria. For example, selecting a viewpoint icon corresponding to a World Series game may be subject to different criteria than a mid-season baseball game. In an embodiment, a selectable viewpoint icon 66*c* may place the player right on the field in the midst of the play action.

Figure 7:
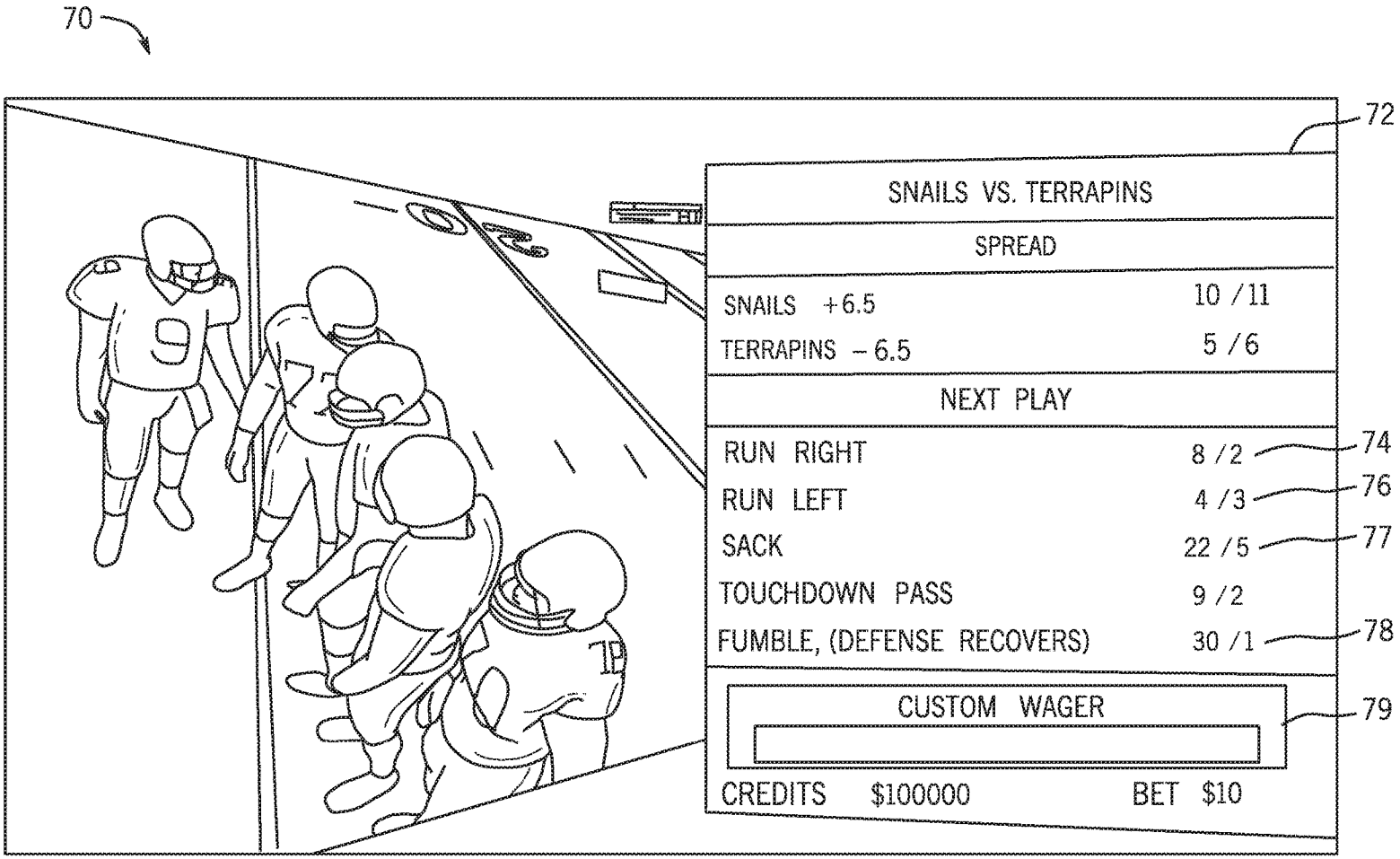
FIG. 7 is an image of an exemplary VR environment of a football game from a viewpoint of a player on the field.

As shown in FIG. 7, a VR environment may include a viewpoint 70 as seen from a position of a participant in the sporting event and the viewpoint 70 may include a betting interface 72 with wager characteristics tailored to the imagery contained in viewpoint 70. In general, betting interfaces may be context-sensitive such that the wager characteristics provided by the interface are responsive to the current viewpoint seen in the VR environment or the viewpoint corresponding to a selected BET icon. Such viewpoints may be computer-generated virtual views and may also be provided as live video feeds delivered by an aerial camera, a drone, and even by a camera affixed to one of the participants of the sporting event. For example, a jockey or football player may carry a helmet-mounted camera that broadcasts video from within the action.

When the viewpoint 70 is shown to the player, the betting interface 72 is also shown including specific wager characteristics associated with the action on the field. In betting interface 72, the player can see bet payouts corresponding to a run to the right 74 or left 76, a sack 77, and a fumble 78. Other exemplary (and non-limiting) wager characteristics may include a hand-off or a pass to a specific player, or a successful block by a guard or tackle. Many other detailed wager characteristics are envisioned to be included in betting interfaces. A betting interface may enable a player to input custom wager characteristics. For example, the betting interface 72 includes custom input window 79 which may accept player-devised wagering criteria. In an embodiment, a player may enter their custom wager characteristics using any of various input methods and the processing circuitry may calculate and display betting payouts corresponding to the custom wager characteristics. If the player likes the displayed payouts and odds, they may wager credits from their credit balance.

A VR environment may depict various other venues and locations besides the abovementioned casino and sportsbook. Similarly, a first viewpoint may be seen from various specific locations and present various depictions of virtual experiences. A VR environment may provide an entire virtual establishment with areas dedicated to gaming machine, others with table games, and still others directed to sports. These and other depictions are considered to be in accordance with the spirit and basic aspects of the invention disclosed herein.

The foregoing description, for purposes of explanation, uses specific nomenclature and formula to provide a thorough understanding of the disclosed embodiments. It should be apparent to those of skill in the art that the specific details are not required in order to practice the disclosed embodiments. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. A gaming system comprising:
- a virtual reality (VR) headset;
- an input interface configured to receive data from an input device;
- an output interface configured to transmit data to the virtual reality (VR) headset; and
- processing circuitry configured to:
  - transmit, to the VR headset via the output interface, a data stream defining a VR environment;
  - direct the VR headset to display visual imagery depicting the VR environment seen from a first viewpoint from within a sportsbook venue tracking a plurality of different sporting events, the first viewpoint including a first betting interface, the first betting interface including one or more wager characteristics enabled in the first viewpoint;
  - receive, from a player wearing the VR headset and via the input interface, an input indicative of a selection of a second viewpoint from within a venue in which one of the plurality of different sporting events is occurring; and
  - direct the VR headset to display visual imagery depicting a VR environment seen from the second viewpoint including a second betting interface, the second betting interface including one or more different wager characteristics enabled in the second viewpoint.

2. The gaming system of claim 1, wherein the second viewpoint is from a player in the one of the plurality of different sporting events and the second betting interface includes wagers on one of an occurrence or an outcome of a particular incident during the sporting event.

3. The gaming system of claim 1, the second viewpoint is from a participant in the one of the plurality of different sporting events and the second betting interface includes wagers on one of an occurrence or an outcome of a particular incident during the sporting event.

4. The gaming system of claim 1, wherein the first betting interface includes wagers on sporting events tracked by the sportsbook venue, and wherein the second viewpoint is from a position at the one of the plurality of different sporting events and the second betting interface includes wagers on one of an occurrence or an outcome of a particular incident during the sporting event.

5. The gaming system of claim 1, wherein the input device is the VR headset.

6. The gaming system of claim 1, wherein the wager characteristics comprise custom-defined wagers.

7. The gaming system of claim 6, wherein the wager characteristics further comprise dynamically-generated custom odds associated with the custom-defined wagers.

8. A gaming system comprising:
- a virtual reality headset;
- an input interface configured to receive data from an input device;
- an output interface configured to transmit data to the VR headset; and
- processing circuitry configured to:
  - transmit, to the VR headset via the output interface, a data stream defining a VR environment;
  - direct the VR headset to display visual imagery depicting the VR environment seen from a first viewpoint from within a sportsbook venue tracking a plurality of different sporting events, the depicted VR environment including
    - a plurality of selectable viewpoints;
  - receive, from a player wearing the VR headset and via the input interface, an input indicative of a selection of a second viewpoint from the plurality of selectable viewpoints, the second viewpoint being from within a venue in which one of the plurality of different sporting events is occurring;
  - direct the VR headset to display visual imagery depicting a VR environment seen from the second viewpoint; and
  - receive, from the player wearing the VR headset via the input interface, an input indicative of a wager associated with the VR environment seen from the second viewpoint.

9. The gaming system of claim 8, wherein the venue comprises a sports arena.

10. The gaming system of claim 9, wherein at least one of the first viewpoint or the second viewpoint includes view-scanning capability based on movement of the VR headset.

11. The gaming system of claim 8, further comprising a wagering game server connected to a communications network, and wherein the data stream defining the VR environment is accessed through the wagering game server via the communications network.

12. The gaming system of claim 8, wherein the second viewpoint is from a spectator seat in a sports arena or the second viewpoint is from a participant in one of the plurality of sporting events.

13. A method of controlling a gaming system, the gaming system including a virtual reality (VR) headset, an input interface configured to receive data from an input device, an output interface configured to transmit data to the VR headset, and processing circuitry connected to the input and output interfaces, the method comprising:

authenticating, by the processing circuitry, an identifier associated with a player activating the VR headset, and storing the identifier in a memory device;

transmitting, to the VR headset via the output interface, a data stream defining a VR environment;

directing, via the processing circuitry, the VR headset to display visual imagery depicting the VR environment seen from a first viewpoint from within a sportsbook venue tracking a plurality of different sporting events, the first viewpoint including a visual presentation of a first betting interface, the first betting interface including one or more wager characteristics enabled in the first viewpoint;

receiving, from the player wearing the VR headset via the input interface, an input indicative of a selection of a second viewpoint, the second viewpoint being from within a venue in which one of the plurality of different sporting events is occurring;

directing, via the processing circuitry, the VR headset to display visual imagery depicting a VR environment seen from the second viewpoint including a visual presentation of a second betting interface, the second betting interface including one or more different wager characteristics enabled in the second viewpoint;

receiving, from the player wearing the VR headset via the input interface, an input indicative of a wager corresponding to at least one of the one or more different wager characteristics; and associating, via the processing circuitry, the wager with the stored identifier.

14. The method of claim 13, wherein the gaming system further comprises a wagering game server connected to a communications network, and wherein the data stream defining the VR environment is accessed through the wagering game server via the communications network.

15. The method of claim 14, wherein the wagering game server includes an account file associated with the player that stores data representing exchangeable value, and wherein the processing circuitry is further configured to debit the exchangeable value in exchange for at least displaying the visual imagery depicting the VR environment seen from the second viewpoint.

16. The method of claim 13, wherein the sportsbook venue is computer-generated by one or more processors executing stored instructions.

17. The method of claim 13, wherein at least one of the first viewpoint or the second viewpoint comprises streaming video content of a real-time event accessed through a wagering game server via a communications network.

18. The method of claim 13, wherein the wager characteristics comprise custom-defined wagers.

19. The method of claim 18, wherein the wager characteristics further comprise dynamically-generated custom odds associated with the custom-defined wagers.

* * * * *